US009327290B2

(12) United States Patent
Alekseev

(10) Patent No.: US 9,327,290 B2
(45) Date of Patent: May 3, 2016

(54) GRINDING MILL

(75) Inventor: Aleksandr Leont'evich Alekseev, Stupino (RU)

(73) Assignee: TWINTECHNOLOGY COMPANY (RU)

( * ) Notice: Subject to any disclaimer, the term of this patent is extended or adjusted under 35 U.S.C. 154(b) by 152 days.

(21) Appl. No.: 14/232,636

(22) PCT Filed: Sep. 28, 2011

(86) PCT No.: PCT/RU2011/000740

§ 371 (c)(1), (2), (4) Date: Jan. 14, 2014

(87) PCT Pub. No.: WO2013/025120

PCT Pub. Date: Feb. 21, 2013

(65) Prior Publication Data

US 2014/0151477 A1 Jun. 5, 2014

(30) Foreign Application Priority Data

Aug. 17, 2011 (RU) ..... 2011134354

(51) Int. Cl.
*B02C 23/18* (2006.01)
*B02C 17/16* (2006.01)
(Continued)

(52) U.S. Cl.
CPC ..... *B02C 23/18* (2013.01); *B02C 13/06* (2013.01); *B02C 17/16* (2013.01); *B02C 17/186* (2013.01)

(58) Field of Classification Search
CPC ..... B02C 13/00; B02C 13/02; B02C 13/06; B02C 13/08; B02C 23/18
USPC ..... 241/189.1, 92, 55, 56, 284
See application file for complete search history.

(56) References Cited

U.S. PATENT DOCUMENTS 54,497 A * 5/1866 Breed ..... B02C 13/26 241/189.1
201,347 A * 3/1878 Hyatt ..... B02C 13/26 241/189.1
2,675,969 A * 4/1954 Stauffer ..... B02C 13/09 241/101.76

(Continued)

FOREIGN PATENT DOCUMENTS

GB 683849 12/1952
RU 2012404 5/1994

(Continued)

OTHER PUBLICATIONS

International Search Report, International application No. PCT/RU 2011/000740.

*Primary Examiner* — Faye Francis
(74) *Attorney, Agent, or Firm* — Yefim Kreydin

(57) ABSTRACT

The invention relates to the devices for dry and wet fine and ultrafine grinding in a wide range of materials, including organic and cellulose-containing, in a mill and can be used in powder metallurgy, radiochemical, medical, agricultural and other industries.

The mill has a body having oppositely charge and discharge pipes. The rotor in form of a disc with grinding elements, mounted on a drive shaft within the body with clearance relative to its lateral surface. The body is freely oriented in the diametric plane of the axis of rotation of the rotor with the possibility of its fixing in the shifted position. The rotor from the side of discharge pipe has blades that perform the functions of the classifier. The charge pipe is equipped with a device to control a supply of air or water to the central part of the rotor.

2 Claims, 2 Drawing Sheets

(51) Int. Cl.
*B02C 17/18* (2006.01)
*B02C 13/06* (2006.01)

(56) References Cited

U.S. PATENT DOCUMENTS 3,173,618 A * 3/1965 Merges ..... B02C 11/08 241/188.1
3,897,014 A * 7/1975 Luthi ..... B02C 13/08 241/163
4,098,466 A * 7/1978 MacElvain ..... B02C 13/09 241/189.1
4,101,080 A * 7/1978 Schmidt ..... B02C 13/286 241/194
4,361,290 A * 11/1982 Francis ..... B02C 13/09 241/186.3
4,428,536 A * 1/1984 Rodgers ..... B02C 13/13 241/154
5,004,167 A * 4/1991 McGee ..... B02C 13/08 241/154
5,386,947 A * 2/1995 Omann ..... E01C 7/182 241/189.1
6,021,966 A * 2/2000 Doenges ..... B02C 13/08 241/189.1
6,431,477 B1 * 8/2002 Pallmann ..... B02C 13/08 241/186.3
7,708,216 B2 5/2010 Yang et al.
2003/0098374 A1 * 5/2003 Kang ..... B02C 13/10 241/56

FOREIGN PATENT DOCUMENTS

RU 2029620 2/1995
RU 2148434 5/2000
RU 2184612 10/2002
RU 2411082 10/2011
SU 1567262 5/1990

* cited by examiner

GRINDING MILL

This application is the United States national phase application of International Application PCT/RU2010/000309 filed Jun. 11, 2010, which claims the benefit of Russian Patent application No RU 201114354 FILED Aug. 17, 2011, the entire disclosure of which is incorporated herein by reference.

The invention relates to the devices for dry and wet fine and ultrafine dispersive grinding of materials of a wide range of natural and high humidity, inorganic, organic, mixtures thereof in a mill of static body. It can be used in the building materials industry, powder metallurgy, radiochemical chemical medical, cellulose, agricultural and other industries.

Some devices are known for the fine and ultrafine grinding by dry and wet methods of mineral and organic materials.

As well a mill is known (RF patent No. 2029620, МПК B02C17/02, 1995г.) for grinding by both wet and dry methods of metallic and nonmetallic materials, comprising two concentrically arranged vertical cylinders, the inner of which is realized as turning element in the horizontal plane, and working bodies and the drive of the inner cylinder, at that the inner cavity of the outer cylinder is divided into chambers by horizontal thresholds, which the working bodies, formed as radially movable pistons are located, forming a discontinuous cylindrical surface between them.

This mill does not solve the problem of the finely dispersive grinding of materials having a nigh elasticity or fibrousness of the structure. The design is complicated to manufacture and operation and requires considerable power consumption.

A centrifugal mill is known (RF patent No. 2411082, МПК B02C17/00, 8 Jun. 2009г.) for dry and wet grinding of bulk solids, comprising a body having a grinding chamber and a spinning rotor in the central part. Into the central part of the rotor through the first feeder a material to be ground is fed and through the second feeder the grinding bodies (balls, cylpebs, pebbles etc.) are fed, the hardness of which is higher than the hardness of the material to be ground. The process of grinding of a starting material is carried out by means of its milling with moving balls when rotor rotating.

A disadvantage of this mill is also the inability of fine dispersive grinding of the organic materials having a high fibrousness. Furthermore, in this mill it is impossible to obtain a uniform in particle size a mass of ground material; grinding body's shears are possible that contaminate the ground product.

A grinding device is also known (RF patent No. 2184612 РФ, МПК B02C15/08, 14 Aug. 2001г.) for grinding of cellulose-containing material and vegetable materials comprising a body of a curved cylindrical surface and lined inside and a rotor separator located within the body. In the upper part of the body the upper inlet duct is located and the outlet duct is located below. In the upper part of the rotor the spreading blades are located and in the bottom part—the raking blades. Rotor separator in the upper grinding zone consists of flat discs with grinding bodies of revolution around the periphery and in the second grinding zone between the bottom flat disks there is a plurality of radial channels on the periphery of which radially vertical pusher plates are installed, and inside of radial channels movable in the radial direction the rotating grinding bodies in the form of cylinders, discs or balls are placed. Outside the device body is equipped with a water jacket. Grinding of material occurs due to a plurality of grinding bodies rolling on the material contacting to a curved bearing surface of the body.

This device is designed only for the finely dispersed grinding of cellulose-containing plant materials, and it is difficult to be manufactured and repaired.

SUMMARY OF THE INVENTION

As a prototype a fine-grinding mill is chosen (RF patent No. 2012404, МПК B02C7/06, B02C13/22, 15, May 1994г.) comprising a body, having pipes to charge and discharge the material, a rotor mounted in the body with a gap relative to its side and end walls. A rotor is represented in the form of two discs interconnected with the axis with bouls on the periphery and the cylinder between them. Grinding of the material occurs in the high-speed grinding chamber, formed by the rotor and end wall of the body.

This design allows obtaining an ultrafine product, but it is designed for grinding of kaolin, talc, mica, graphite in the building material industry. Using of this mill is not possible to obtain ultrafine grinding of the materials of high fibrous structure and high humidity, as well as perform wet grinding.

The object of the invention is to provide such a mill that can grind a wide range of materials to the desired degree of grinding (within 5-10 microns); including organic, cellulose-containing fibrous materials of natural and high humidity both by wet and dry methods of extremely narrow size distribution.

Said result is achieved in such away that in a null comprising a body having opposite located charge and discharge pipes, a rotor in the form of a disc with grinding elements, mounted on a drive shaft inside the body with clearance relative to the its side surface, according to the invention the body is freely oriented in the diametric plane of the axis of the error rotation with a possibility of its fixing in the displaced position, the rotor from the side of the discharge pipe has blades, operating as a classifier, and the charging pipe is equipped with a device to control a supply of air or water to the central part of the rotor.

Design features of the claimed mill, associated with free orientation of the body relative to the rotor rotation axis, in conjunction with the other features, also allow creating conditions for the breaking of the fibers of organic materials, to solve the problem of grinding of a wide range of materials to a predetermined degree of milling (within 5-10 microns) of ultra-narrow size distribution.

The drawings show:

DETAILED DESCRIPTION OF THE EXEMPLARY EMBODIMENTS

Figure 1:
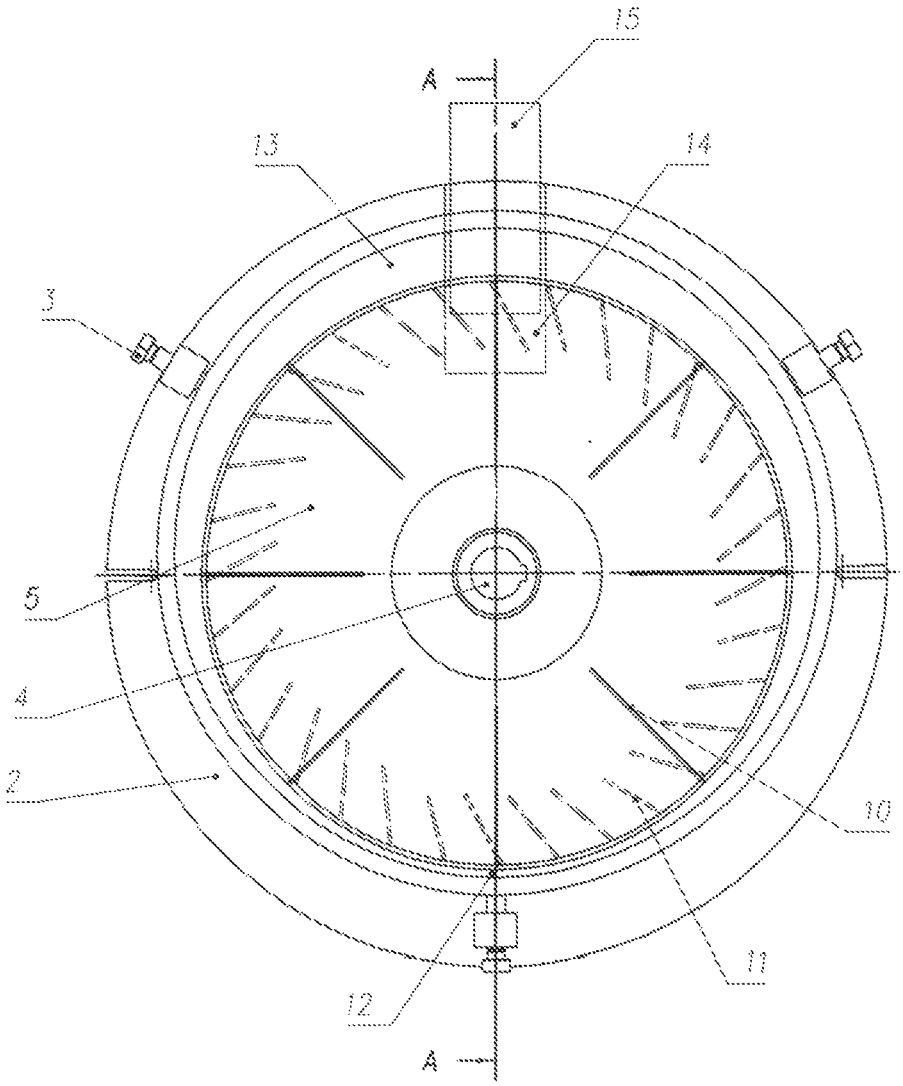
FIG. 1—view of the mill from the inlet pipe (inlet pipe is not shown)
Figure 2:
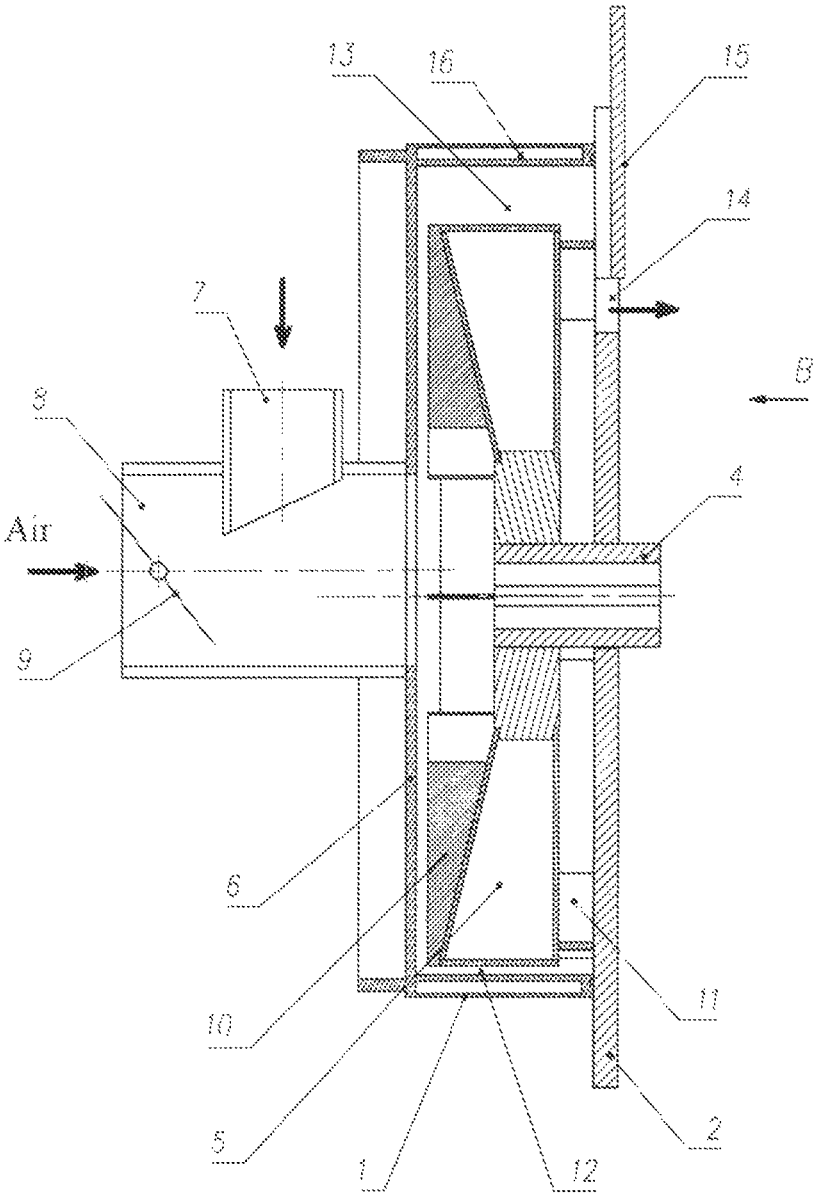
FIG. 2—frontal section of the mid along A-A of FIG. 1.

Mill (FIGS. 1, 2) consists of a grinding chamber body 1, which is attached to the mill base 2 by means of fastening screws 3 (not less than 3 pcs.) to fix position of the body 1 in the diametric plane of the axis of rotation of the rotor 5. In the central part of the mill the rotor 5 is located on the drive shaft 4. In the cover 6 of the grinding chamber 1 the charge pipe 7 is located, combined with the air intake duct 8 or water intake duct with regulating valve 9 located along the central axis of the shaft 4 of the rotor 5. Rotor 5 from the side of the charging pipe has a radially located blades 10 (grinding elements). From the side of the discharge pipe 14 rotor 5 is equipped with blades 11, which serve as a classifier. Fastening screws 3 control the mill camera body 1 on the mill basis 2, so that rotor 5 forms a grinding zone 12 and a discharge zone 13 with the inner surface of the body. In the discharge zone 13 at the base of the mill 2 is a discharge pipe 14 with the adjustable sliding shutter 15 is located. Grinding chamber 1 has a water cooling chamber 16.

The mill operates as follows.

The starting material having a particle size of diameter tip to 25 mm is supplied with air or water through a charge pipe 7 into the center of the grinding chamber 1, where it is affected by centrifugal and hydro- or aerodynamics forces, and the material is distributed by blades 10 of the rotor 5 along the inner surface of the body 1 of the grinding chamber. Material, entering the vortex flow generated by the blades 10 of the rotor 5, is pushed into the grinding zone 12, where the grinding of material is performed due to friction forces and centrifugal forces by exposing it to predominantly compressive loads generated under the speed linear rolling on the ground material of the rotor 5 which is contacting with the surface body 1 of the mill chamber. Friction between the particles of the ground material inside the particles themselves, due to compressive loads promotes occurrence of microfractures in the entire volume of destructed material particles, which leads to an increase in the microfractures in a ground particle and its effective destruction due to compressive loads, thereby increasing dispersibility of the finished ground material and its physical and (mechanical)-chemical, and chemical activation. Rotor 5 moves to the wall of the grinding chamber 1 due to adjusting and hard fixing of the screws 3, and due to this motion a grinding zone 12 and a discharge zone 13 are created, in which multiply changing force actions onto a material occurs, which create high-effective fatigue loadings additionally. Grinding of the material is performed in high-speed mode upon multiple simultaneous compressive and abrasive loads, which creates the conditions for grinding due to autogeneously grinding of material. Destructive effect of these loads have the repetitive in time nature with alternating of processes of the stress field initiation in the grinding zone 12 and a free field in the discharge zone 13 and the local nature of the mechanical effects on the material. Vortex flow transports the ground material from the grinding zone 12 into the discharge zone 13 where the classification of the ground material and its transporting into a hopper (not shown) take place by means of the classification blades 11 and adjustment of the sliding shutter 15 in the discharge pipe 14.

When grinding the organic fine fiber materials, particularly cellulose, the rolling of fibers in the form of a ball, their coagulation and their subsequent failure and the breaking of the fiber in the grinding zone occurs.

Under wet grinding water is supplied through the channel 8 and the grinding of material is performed in the hydrodynamic regime.

The advantage of this mill is that it allows grinding mineral and organic materials of natural and high humidity into a fine powder up to 5-10 microns of extremely narrow size distribution. And also to perform the activation of physical-(mechanical)-chemical, chemical processes, materials, improving their quality characteristics. The mill design allows increasing the lifetime of the mill due to the principle of grinding material by friction and the possibility to adjust the position of the body. Material is ground due to friction that contributes to the destruction of the material with the smallest power consumption. As a result of the grinding the maximum surface of the ground solid is obtained with minimum power consumption that optimizes the process.

Mills of the claimed design have been manufactured and tested in the works with a positive result.

The invention claimed is:

1. A grinding mill, comprising a mill base, a body having a charging pipe for grinding materials, said body movably mounted to the base, a discharge pipe a rotor in form of a disk with two sides mounted within the body on a drive shaft, said shaft passing through the base, wherein the disk having distribution vanes on the one side from the charging pipe, said distribution vanes guiding the grinding materials to an inner surface of the body and having varies on the other side from the discharge nozzle operating as function classifier, and the body equipped with units for fixing to the base for an eccentric installation the body relative to the drive shaft.

2. The grinding mill of claim 1, additionally comprising a device for controlling supplying air or water into a central part of the rotor, said device being installed in the charging pipe.

* * * * *